US011411326B2

(12) United States Patent
Leung et al.

(10) Patent No.: US 11,411,326 B2
(45) Date of Patent: Aug. 9, 2022

(54) BROADBEAM DIELECTRIC RESONATOR ANTENNA

(71) Applicant: City University of Hong Kong, Kowloon (HK)

(72) Inventors: Kwok Wa Leung, Kowloon (HK); Zhen-Xing Xia, Kowloon (HK)

(73) Assignee: City University of Hong Kong, Kowloon (HK)

( * ) Notice: Subject to any disclaimer, the term of this patent is extended or adjusted under 35 U.S.C. 154(b) by 274 days.

(21) Appl. No.: 16/892,613

(22) Filed: Jun. 4, 2020

(65) Prior Publication Data

US 2021/0384648 A1 Dec. 9, 2021

(51) Int. Cl.
*H01Q 25/00* (2006.01)
*H01Q 13/10* (2006.01)

(52) U.S. Cl.
CPC ..... *H01Q 25/002* (2013.01); *H01Q 13/10* (2013.01)

(58) Field of Classification Search
CPC ..... H01Q 25/002; H01Q 13/10; H01Q 9/0485
See application file for complete search history.

(56) References Cited

U.S. PATENT DOCUMENTS

| | | | | |
|---|---|---|---|---|
| 5,952,972 | A * | 9/1999 | Ittipiboon | H01Q 9/0485 343/873 |
| 5,955,997 | A | 9/1999 | Ho et al. | |
| 6,072,437 | A | 6/2000 | Zimmerman et al. | |
| 6,166,709 | A | 12/2000 | Goldstein | |
| 6,243,049 | B1 | 6/2001 | Chandler | |
| 8,872,714 | B2 | 10/2014 | Hozouri | |
| 9,590,310 | B1 | 3/2017 | Barts et al. | |
| 9,728,856 | B2 | 8/2017 | Foo | |
| 9,825,373 | B1 | 11/2017 | Smith | |
| 9,887,466 | B2 | 2/2018 | Ermutlu et al. | |
| 10,892,544 | B2 * | 1/2021 | Pance | H01Q 19/06 |
| 2005/0068243 | A1 * | 3/2005 | Chen | H01Q 5/371 343/792 |
| 2017/0271772 | A1 * | 9/2017 | Miraftab | H01Q 9/0485 |
| 2019/0341695 | A1 * | 11/2019 | Pan | H01Q 9/0485 |
| 2021/0096209 | A1 * | 4/2021 | Daigle | G01S 7/006 |

FOREIGN PATENT DOCUMENTS

| | | | | |
|---|---|---|---|---|
| CN | 110416713 A * | 11/2019 | | H01Q 1/36 |
| WO | WO-2012081956 A1 * | 6/2012 | | H01Q 1/2291 |

OTHER PUBLICATIONS

Chih-Yu Huang, Jian-Yi Wu and Kin-Lu Wong, "Cross-slot-coupled microstrip antenna and dielectric resonator antenna for circular polarization," in IEEE Transactions on Antennas and Propagation, vol. 47, No. 4, pp. 605-609, Apr. 1999, doi: 10.1109/8.768798. (Year: 1999).*

* cited by examiner

*Primary Examiner* — Dameon E Levi
*Assistant Examiner* — Anh N Ho
(74) *Attorney, Agent, or Firm* — Renner Kenner Greive Bobak Taylor & Weber

(57) ABSTRACT

A dielectric resonator antenna and a dielectric resonator antenna array. The dielectric resonator antenna includes a ground plane, a dielectric resonator element operably coupled with the ground plane, and a feed network operably coupled with the dielectric resonator element for exciting the dielectric resonator antenna. The dielectric resonator element includes a first portion with a first shape and a second portion with a second shape different from the first shape. The dielectric resonator antenna, when excited, is arranged to provide wide half-power beam-widths in both E-plane and H-plane.

26 Claims, 7 Drawing Sheets

BROADBEAM DIELECTRIC RESONATOR ANTENNA

TECHNICAL FIELD

The invention relates to a broadbeam dielectric resonator antenna and a related dielectric resonator antenna array. The invention also relates to their method of making, and a communication device incorporating the broadbeam dielectric resonator antenna or the related dielectric resonator antenna array.

BACKGROUND

Broadbeam antennas can potentially be used to realize phased antenna array with wide-angle beam scanning. Known broadbeam antennas include, for example, pattern-reconfigurable patch antennas and multimode patch antennas. These antennas can improve beam converge. However, they all require complex dc biasing circuits, which inevitably reduces the radiation efficiencies of the antennas.

SUMMARY OF THE INVENTION

In a first aspect of the invention, there is provided a dielectric resonator antenna including a ground plane, a dielectric resonator element operably (e.g., electrically) coupled with the ground plane, and a feed network operably coupled with the dielectric resonator element for exciting the dielectric resonator antenna. The dielectric resonator element includes a first portion with a first shape and a second portion with a second shape different from the first shape. The dielectric resonator antenna, when excited, is arranged to provide wide half-power beam-widths in both E-plane and H-plane. The dielectric resonator element may be formed by the first and second portions only, or the dielectric resonator element may include additional portions. In one embodiment, the antenna includes one or more additional dielectric resonator elements. In one embodiment, the dielectric resonator element is entirely solid (non-hollow).

In one embodiment of the first aspect, the dielectric resonator antenna, when excited, is arranged to provide: a half-power (3-dB) beam-width of larger than 900 in the E-plane and a half-power (3-dB) beam-width of larger than 900 in the H-plane. In another embodiment of the first aspect, the dielectric resonator antenna, when excited, is arranged to provide: a half-power beam-width of larger than 110° in the E-plane and a half-power beam-width of larger than 110° in the H-plane. In yet another embodiment of the first aspect, the dielectric resonator antenna, when excited, is arranged to provide: a half-power beam-width of about 120° to about 130° (e.g., about 125°) in the E-plane and a half-power beam-width of about 120° to about 130° (e.g., about 124°) in the H-plane.

The E-plane includes an E-plane co-polar field and an E-plane cross-polar field. The H-plane includes an H-plane co-polar field and an H-plane cross-polar field. In one embodiment of the first aspect, the half-power beam-width above applies to the E-plane co-polar field and/or H-plane co-polar field. In one example, the E-plane co-polar field is larger than the E-plane cross-polar field, e.g., by at least 10 dB, by at least 20 dB, by at least 25 dB, or by at least 30 dB. In one example, the H-plane co-polar field is larger than the H-plane cross-polar field, e.g., by at least 10 dB, by at least 20 dB, or by at least 25 dB.

In one embodiment of the first aspect, the first portion has a first volume and the second portion has a second volume. The first and second volumes may be the same or different.

In one embodiment of the first aspect, the first portion has a first dielectric constant and the second portion has a second dielectric constant different from the first dielectric constant. The first dielectric constant may be larger than the second dielectric constant.

In one embodiment of the first aspect, the first portion is made of a first material and the second portion is made of a second material different from the first material. The first and second materials are dielectric materials. For example, the first material may be a ceramic material and/or the second material may be a ceramic material.

In one embodiment of the first aspect, the first portion and the second portion are integrally formed. In one embodiment, the dielectric resonator element is additively manufactured using an additive manufacturing machine such as a 3D printer. For example, the dielectric resonator element is 3D printed or otherwise produced, e.g., via fused deposition modelling technique, using a 3D printer.

In one embodiment of the first aspect, the dielectric resonator element is rotationally symmetric.

In one embodiment of the first aspect, the first portion is arranged between the second portion and the ground plane. The second portion may be stacked on the first portion, which in turn may be stacked on the ground plane.

In one embodiment of the first aspect, the first shape is in the form of a cylinder and/or the second shape is in the form of a truncated spheroid. The truncated spheroid may be a truncated prolate spheroid or a truncated oblate spheroid. The truncated spheroid may be a regular truncated spheroid. In one example, the second shape is in the form of a hemi-spheroid.

In one embodiment of the first aspect, the first shape is in the form of a cylinder with a radius and the second shape is in the form of a regular truncated spheroid. The spheroid (before truncation) has a major axis length and a minor axis length. The minor axis length may be substantially the same as the radius. In one embodiment of the first aspect, the second shape is in the form of a hemi-spheroid directly connected with the cylinder to form the dielectric resonator element.

In one embodiment of the first aspect, the dielectric resonator element is mounted on the ground plane. For example, the dielectric resonator element is directly attached to the ground plane.

In one embodiment of the first aspect, the dielectric resonator antenna is a slot-coupled antenna.

In one embodiment of the first aspect, the dielectric resonator antenna is a X-band dielectric resonator antenna.

In one embodiment of the first aspect, the feed network comprises a slot in the ground plane. The slot may be etched in the ground plane. In plan view the slot is within a footprint of the dielectric resonator element. The slot may have a cross-shaped cross section, which provides circular polarization, or a rectangular cross section, which provides linear polarization. In one example, in plan view the slot is arranged centrally within the footprint of the dielectric resonator element.

In one embodiment of the first aspect, the dielectric resonator antenna further includes a PCB substrate with an outer surface with a conductive layer, and the ground plane is provided by the conductive layer. The outer surface with the conductive layer may be the top surface. The PCB substrate may include any number of conductive layers. For example, the PCB substrate may be a single-sided PCB substrate without only one conductive layer, a double-sided PCB substrate with conductive layers on both sides.

In one embodiment of the first aspect, the feed network further comprises a microstrip feedline arranged on an outer surface of the PCB substrate opposite the conductive layer.

In one embodiment of the first aspect, the ground plane has a size of at least $\lambda_o \times \lambda_o$, where $\lambda_o$ is a wavelength in air at a center frequency of an operation band of the dielectric resonator antenna. In one example, the ground plane may have a size of $n\lambda_o \times n\lambda_0$, where n is any integer.

In a second aspect of the invention, there is provided a dielectric resonator antenna array that includes a ground plane, a plurality of dielectric resonator elements arranged on the ground plane, and a feed network operably coupled with the dielectric resonator elements for exciting the dielectric resonator antenna array. Each of the plurality of the dielectric resonator elements includes, respectively, a first portion with a first shape and a second portion with a second shape different from the first shape. The dielectric resonator antenna array, when excited, is arranged to provide wide angle scanning in both E-plane and H-plane. In one example, the dielectric resonator antenna array can scan from about −75° to about +75° with 3-dB gain fluctuation.

In one embodiment of the second aspect, the dielectric resonator elements are arranged in a regular array (evenly spaced in at least one dimension). In another embodiment of the second aspect, the dielectric resonator elements are arranged in an irregular array.

In one embodiment of the second aspect, the dielectric resonator antenna array is a phased antenna array.

In one embodiment of the second aspect, the feed network comprises a plurality of sub-networks each associated with a respective dielectric resonator element.

In one embodiment of the second aspect, the dielectric resonator elements may each be a dielectric resonator element of the first aspect.

In a third aspect of the invention, there is provided a communication device having the dielectric resonator antenna of the first aspect. The communication device may be a wireless communication device adapted for 5G wireless operations. In one embodiment, the communication device may be used for other wireless operations. The communication device may be a mobile phone, a wearable device, an IoT device, a computer, a tablet, a smart watch, a satellite communication system, etc.

In a fourth aspect of the invention, there is provided a communication device having the dielectric resonator antenna array of the second aspect. The communication device may be a wireless communication device adapted for 5G wireless operations. In one embodiment, the communication device may be used for other wireless operations. The communication device may be a mobile phone, a wearable device, an IoT device, a computer, a tablet, a smart watch, a satellite communication system, etc.

In a fifth aspect of the invention, there is provided a method of making a dielectric resonator antenna of the first aspect. The method includes processing a computer model of the dielectric resonator antenna element in the dielectric resonator antenna using an additive manufacturing machine; forming the dielectric resonator antenna element using the additive manufacturing machine; and operably connecting the dielectric resonator antenna element to the feed network and the ground plane to form the dielectric resonator antenna. The computer model may be a CAD drawing. The additive manufacturing machine may be a 3D printer. In one example, the 3D printer may be a fused deposition modelling 3D printer.

In one embodiment of the fifth aspect, the method further includes creating a computer model of the dielectric resonator antenna element of the dielectric resonator antenna.

In one embodiment of the fifth aspect, the method further includes creating a computer model of the dielectric resonator antenna.

In a sixth aspect of the invention, there is provided a method of making a dielectric resonator antenna array of the second aspect. The method includes processing a computer model of the dielectric resonator antenna elements in the dielectric resonator antenna array using an additive manufacturing machine; forming the dielectric resonator antenna elements using the additive manufacturing machine may; and operably connecting the dielectric resonator antenna elements to the feed network and the ground plane to form the dielectric resonator antenna array. The computer model may be a CAD drawing. The additive manufacturing machine may be a 3D printer. In one example, the 3D printer may be a fused deposition modelling 3D printer.

In one embodiment of the sixth aspect, the method further includes creating a computer model of the dielectric resonator antenna elements in the dielectric resonator antenna array.

In one embodiment of the sixth aspect, the method further includes creating a computer model of the dielectric resonator antenna array.

In a seventh aspect of the invention there is provided a computer program that, when executed by an additive manufacturing machine, causes the additive manufacturing machine to produce the dielectric resonator antenna element in the dielectric resonator antenna of the first aspect or to produce one or more of the dielectric resonator antenna elements in the dielectric resonator antenna array of the second aspect. The additive manufacturing machine may be a 3D printer, which for example may be a fused deposition modelling 3D printer.

In an eighth aspect of the invention there is provided a computer model of: the dielectric resonator antenna element of the dielectric resonator antenna of the first aspect, or one or more of the dielectric resonator antenna elements in the dielectric resonator antenna array of the second aspect. The computer model may be a CAD drawing.

In a ninth aspect of the invention there is provided a computer model of the dielectric resonator antenna of the first aspect or the dielectric resonator antenna array of the second aspect. The computer model may be a CAD drawing.

In a tenth aspect of the invention there is provided a computer program product storing the computer program (codes, instructions, data, etc.) of the seventh aspect, the computer model of the eighth aspect, and/or the computer model of the ninth aspect.

In an eleventh aspect of the invention there is provided an additive manufacturing machine arranged to make the dielectric resonator antenna element of the dielectric resonator antenna of the first aspect, or one or more of the dielectric resonator antenna elements in the dielectric resonator antenna array of the second aspect. The additive manufacturing machine stores and is arranged to process a computer model of the dielectric resonator antenna element of the dielectric resonator antenna of the first aspect, or one or more of the dielectric resonator antenna elements in the dielectric resonator antenna array of the second aspect, then additively manufactures the dielectric resonator antenna element of the dielectric resonator antenna of the first aspect, or one or more of the dielectric resonator antenna elements in the dielectric resonator antenna array of the second aspect.

The additive manufacturing machine may be a 3D printer, which for example may be a fused deposition modelling 3D printer.

In a twelfth aspect of the invention there is provided the dielectric resonator antenna element in the dielectric resonator antenna of the first aspect.

In a thirteenth aspect of the invention there is provided one or more of the dielectric resonator antenna elements in the dielectric resonator antenna array of the second aspect.

Expressions such that "generally", "about", "substantially", or the like, depending on context, are used to take into account manufacture tolerance, assembly tolerance, degradation, trend, tendency, errors, or the like, which may be plus or minus 10%, plus or minus 5%, plus or minus 2%, plus or minus 1%, etc., of the indicated value.

BRIEF DESCRIPTION OF THE DRAWINGS

Embodiments of the invention will now be described, by way of example, with reference to the accompanying drawings in which.

DETAILED DESCRIPTION

Figure 1A:
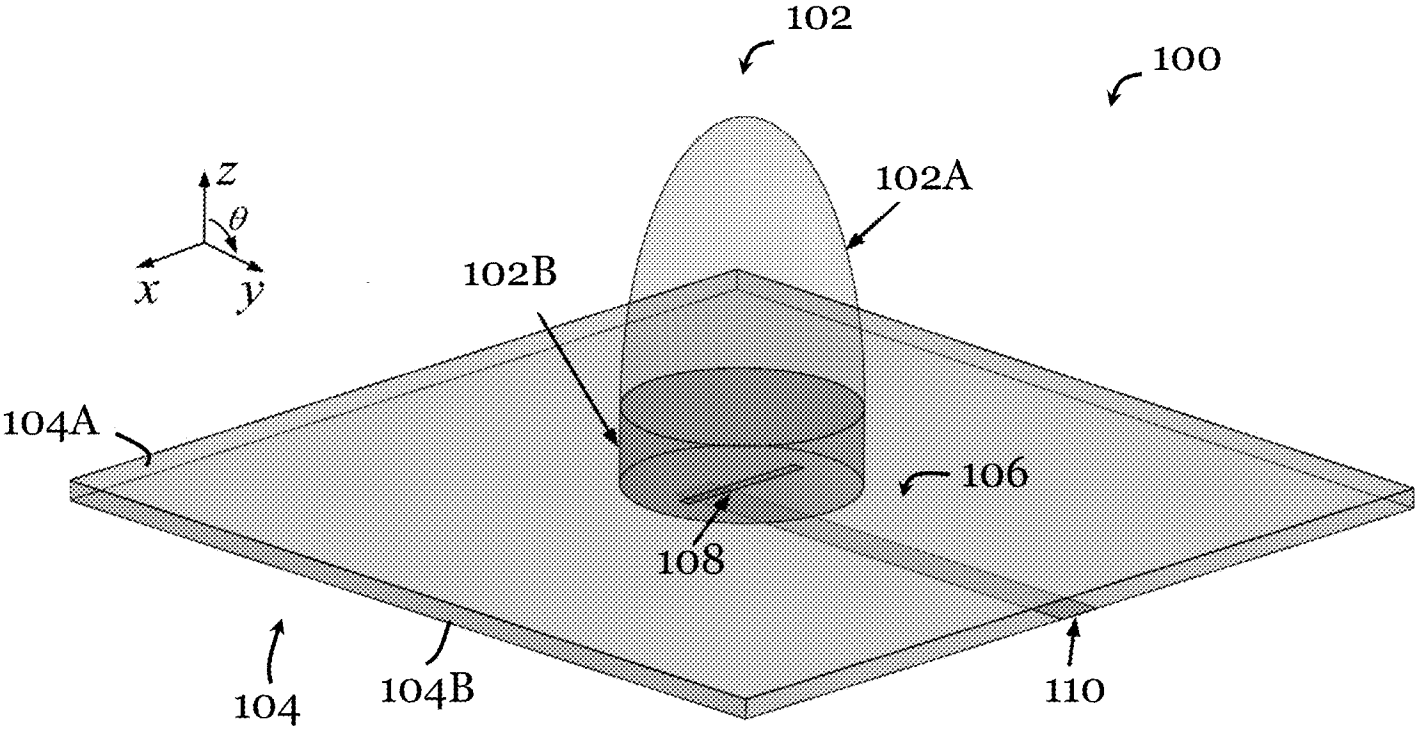
FIG. 1A is a perspective view of a dielectric resonator antenna in one embodiment of the invention.
Figure 1C:
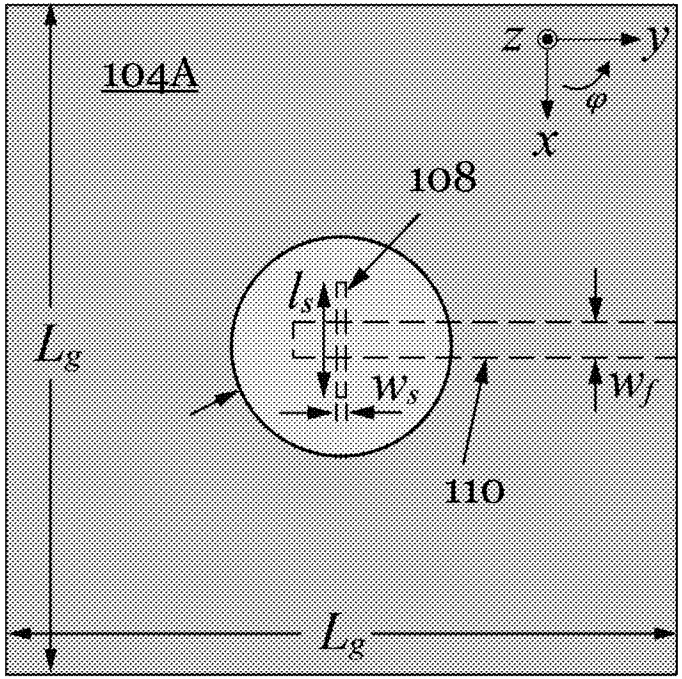
FIG. 1C is a top view of the dielectric resonator antenna of FIG. 1A.
Figure 1B:
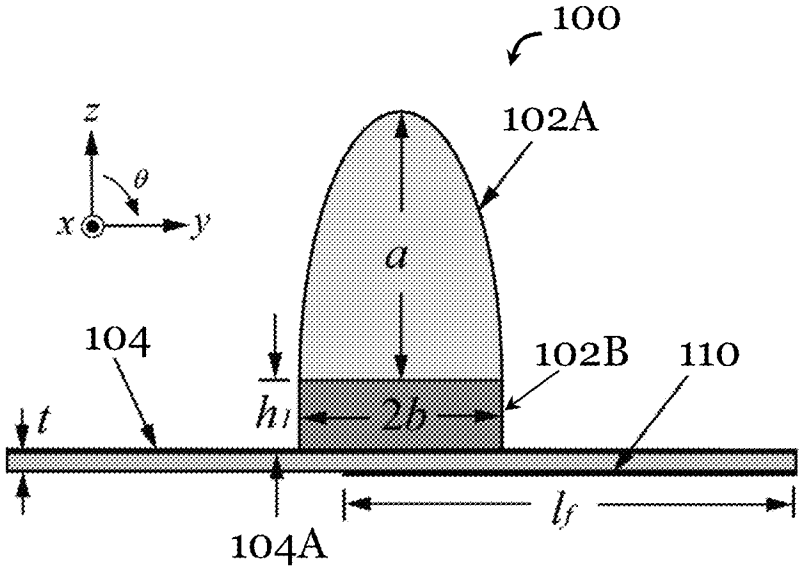
FIG. 1B is a side view of the dielectric resonator antenna of FIG. 1A.

FIGS. 1A to 1C show a dielectric resonator antenna 100 in one embodiment of the invention. The dielectric resonator antenna 100, when excited, is arranged to provide wide half-power beam-widths in both E-plane and H-plane.

Referring to FIGS. 1A to 1C, the dielectric resonator antenna 100 includes a dielectric resonator element 102 mounted on a rectangular (squared) printed circuit board (PCB) substrate 104. The PCB substrate 104 is a double-sided PCB substrate with conductive layers 104A, 104B on upper and lower surfaces. The PCB substrate 104 has a side length $L_g$, a side width $L_g$ and a thickness t. The middle layer of the PCB substrate 104 (the layer other than the upper and lower conductive layers 104A, 104B) has a dielectric constant ers. The upper conductive layer 104A provides a ground plane for the antenna 100. The dielectric resonator element 102 is mounted and operably connected with the ground plane. The ground plane has a size $2\lambda_o \times 2\lambda_o$, where $\lambda_o$ is a wavelength in air at a center frequency of an operation band of the dielectric resonator antenna 100.

The PCB substrate 104 also provides a feed network 106 operably coupled with the dielectric resonator element 102 for exciting the dielectric resonator antenna 100. The dielectric resonator antenna 100 is a slot-coupled antenna. The feed network 106 includes a rectangular slot 108, with a width $w_s$ and a length $l_s$, etched in the ground plane, and a 50-Ω rectangular microstrip line 110 (feedline) with a width of $w_f$. The microstrip line 110 provides the bottom conductive layer 104B of the PCB substrate 104.

The dielectric resonator element 102 consists of an upper portion 102A and a lower portion 102B of different shapes and different dielectric constants. The lower portion 102B is arranged between the upper portion 102A and the ground plane. The lower portion 102B is cylindrical (e.g., a cylindrical dielectric block) with a radius b and a height $h_1$. The lower portion 102B is made of a material (e.g., ceramic material) with a dielectric constant $\varepsilon_{r1}$. The upper portion 102A is a hemi-spheroidal (prolate spheroidal) with a major axis length a and minor axis length b (the major and minor axes are with respect to the spheroid). In other words, the minor axis length of the upper portion 102A is the same as the radius of the lower portion 102B. Because of this, and the upper and lower portions 102A, 102B are directly connected with each other, the contour of the dielectric resonator element 102 is generally smooth. The dielectric resonator element 102 in FIG. 1A has rotationally symmetry. The upper portion 102A is made of a material (e.g., ceramic material) with a dielectric constant $\varepsilon_{r2}$ different from the dielectric constant $\varepsilon_{r1}$. The dielectric resonator element 102 can be additively manufactured using an additive manufacturing machine, e.g., 3D printed using a 3D printer. A 3D printer is a known device so will not be described here.

As shown in FIGS. 1A and 1C, in plan view, the rectangular slot 108 and the rectangular microstrip line 110 are generally perpendicular to each other. The rectangular slot 108 is within a footprint of the dielectric resonator element 102, generally centrally within the footprint of the dielectric resonator element 102.

In this embodiment, the broad beam dielectric resonator antenna 100 is arranged for operation in the X-band. Using ANSYS HFSS, an antenna prototype with the following values of parameters are obtained: $\varepsilon_{r1}=10$, $\varepsilon_{r2}=5$, a=4.5 mm, b=12 mm, $h_1=3.2$ mm, $l_s=6$ mm, $w_s=0.5$ mm, $w_f=1.82$ mm, $\varepsilon_{rs}=3.55$, $L_g=60$ mm, and t=0.8 mm.

Figure 2:
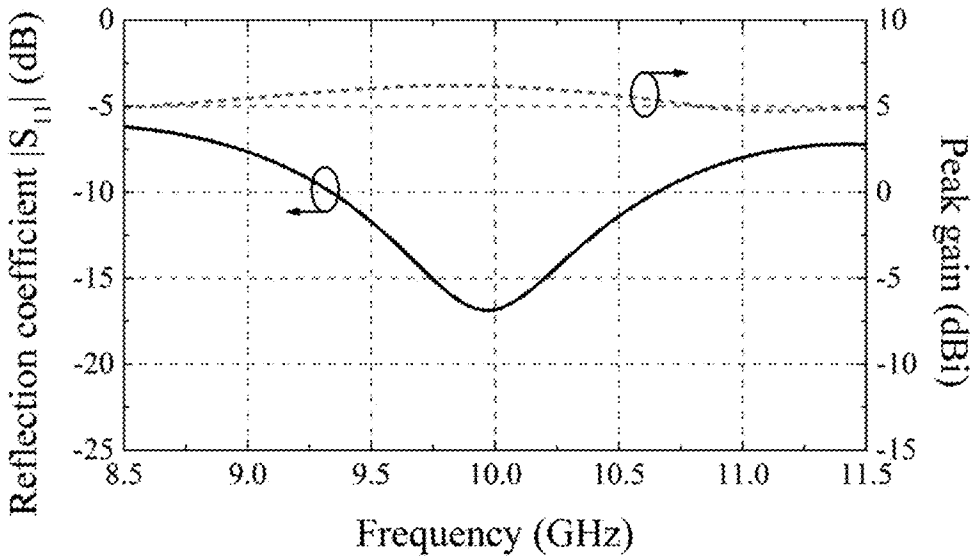
FIG. 2 is a graph showing simulated reflection coefficient and peak gain of the dielectric resonator antenna of FIG. 1A.

FIG. 2 shows the simulated reflection coefficient and realized peak gain of the antenna 100 of FIGS. 1A to 1C with the above-specified parameters. As shown in FIG. 2, the antenna 100 has a simulated 10 dB impedance bandwidth of 12.3% (9.34-10.56 GHz). The simulated realized peak gain varies between 5.4 and 6.2 dBi across the impedance passband.

Figure 3B:
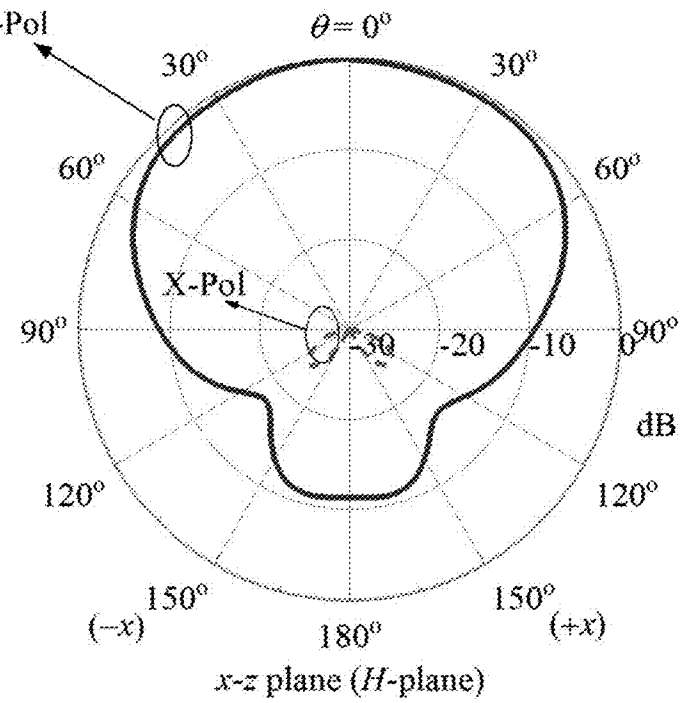
FIG. 3B is a plot showing simulated radiation pattern of the dielectric resonator antenna of FIG. 1A in the H-plane at 10 GHz.
Figure 3A:
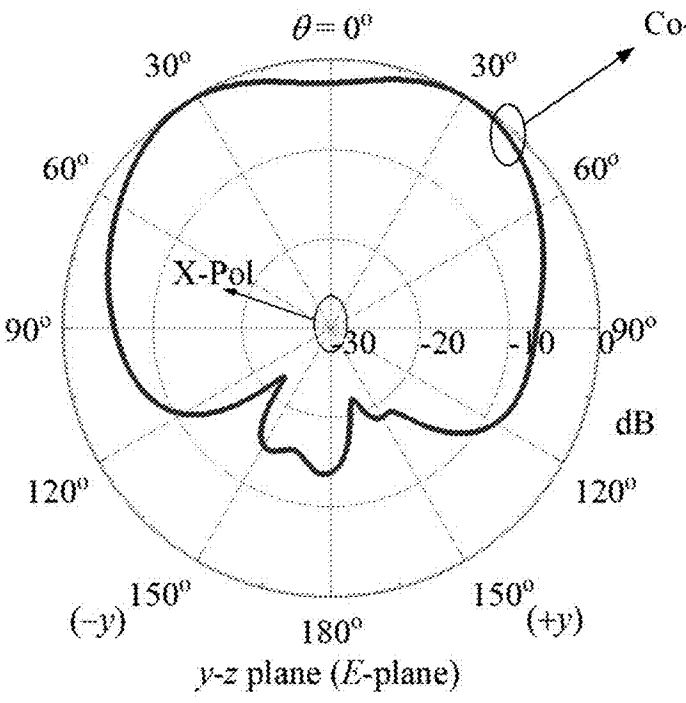
FIG. 3A is a plot showing simulated radiation pattern of the dielectric resonator antenna of FIG. 1A in the E-plane at 10 GHz.

FIGS. 3A and 3B show the simulated normalized 2D radiation patterns of the antenna 100 in the E-plane and the H-plane respectively at 10 GHz. In the E-plane, the simulated co-polar field is stronger than its cross-polar field by more than 30 dB. In the H-plane, the co-polar field is stronger than the cross-polar field by at least 25 dB. FIGS. 3A and 3B also show that the antenna has a wide 3-dB (half-power) beamwidths in both the E-plane and the H-plane. The 3-dB beamwidths are about 1250 in the E-plane and about and 124° in the H-plane.

Figure 4A:
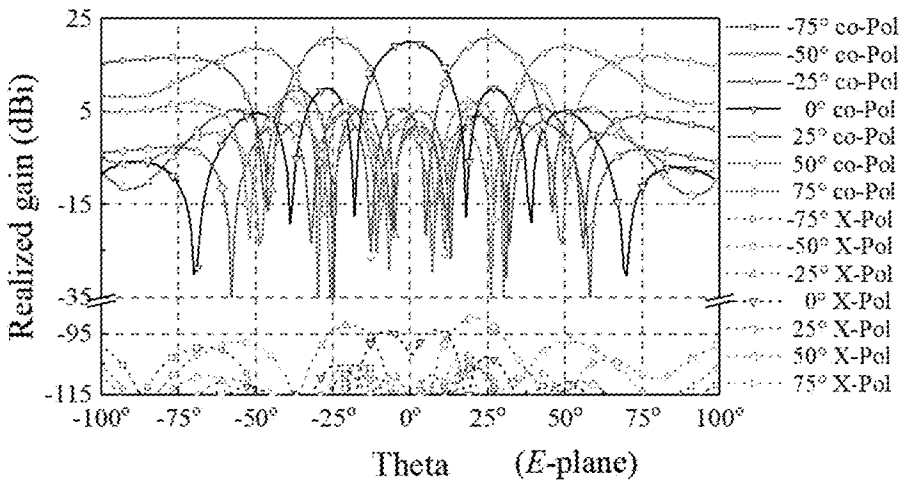
FIG. 4A is a graph showing simulated beam-scanning result of a dielectric resonator antenna array in the E-plane at 10 GHz in one embodiment of the invention.
Figure 4B:
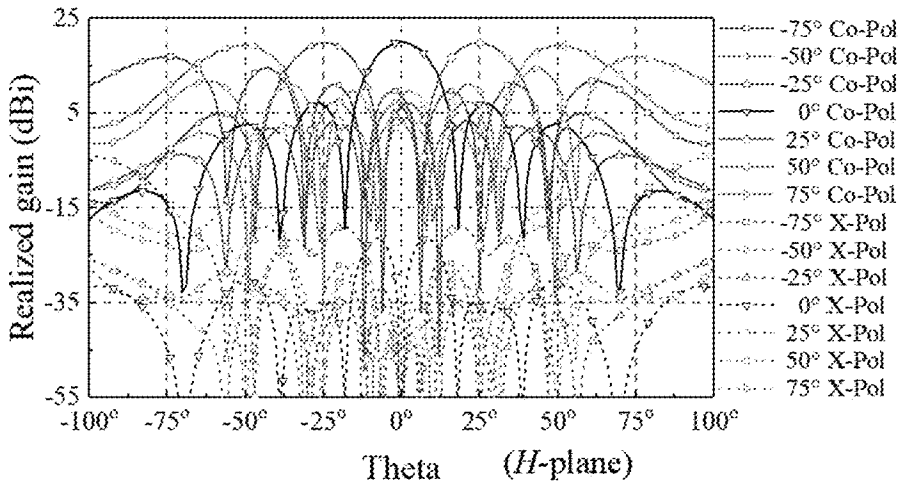
FIG. 4B is a graph showing simulated beam-scanning result of the dielectric resonator antenna array (same as the one in FIG. 4A) in the H-plane at 10 GHz in one embodiment of the invention.
Figure 6:
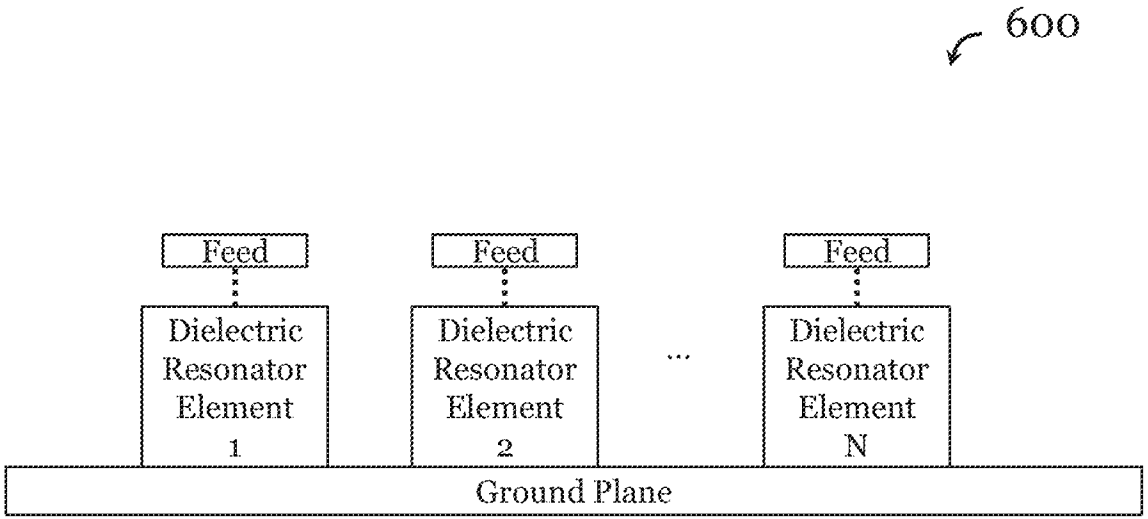
FIG. 6 is a functional block diagram of a dielectric resonator antenna array in one embodiment of the invention.

A dielectric resonator antenna array can be made based on the dielectric resonator element in FIGS. 1A to 1C. The dielectric resonator antenna array includes the ground plane, multiple dielectric resonator elements arranged in an array and mounted on the ground plane, and a feed network (e.g., sub-networks each associated with a respective dielectric resonator element). FIG. 6 illustrates such a dielectric resonator antenna array 600 in one example. In one example, the dielectric resonator antenna array includes 64 dielectric resonator elements (e.g., the dielectric resonator elements 102) arranged in an 8×8 phased array. FIGS. 4A and 4B show the beam-scanning results in the E-plane and H-plane at 10 GHz for such an 8×8 phased array. As shown in FIGS. 4A and 4B, the phased antenna array shows wide-angle scanning ability in the both E-plane and H-plane—it can scan from −75° to +75° with 3-dB gain fluctuation. This result demonstrates the performance of the wide-angle scanning phased antenna array.

Figure 5:
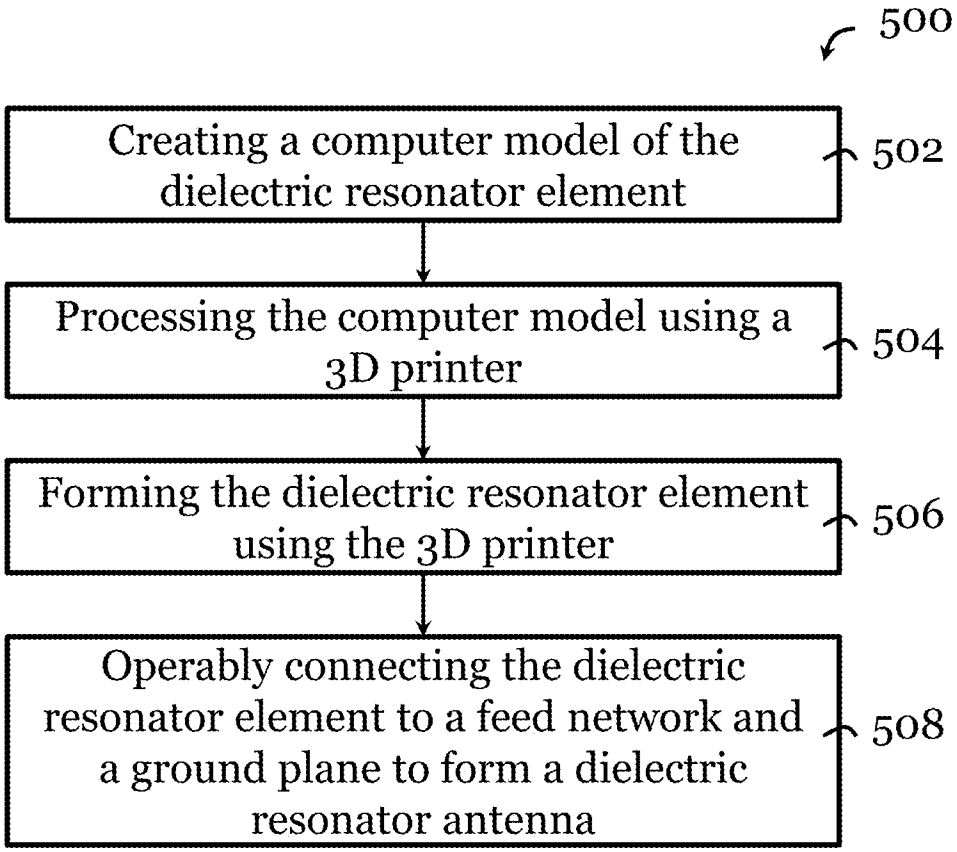
FIG. 5 is a flow chart showing a method for making a dielectric resonator antenna in one embodiment of the invention.

FIG. 5 is a method 500 for making the dielectric resonator antenna in one embodiment of the invention. The dielectric resonator antenna can be the dielectric resonator antenna 100 in FIGS. 1A to 1C. The method 500 begins in step 502, in which a computer model (e.g., CAD drawing) of the dielectric resonator element is created. Then, in step 504, the computer model is loaded or otherwise accessed by (e.g., stored) a 3D printer, and the 3D printer processes the computer model. The 3D printer may be a fused deposition modeling (FDM) 3D printer, which can produce the element using one or more materials (e.g., ceramics). Subsequently, in step 506, the 3D printer produces the dielectric resonator element based on the computer model. A dielectric resonator element is be formed. After the dielectric resonator element is formed, in step 508, the dielectric resonator element is operably connected to a feed network and a ground plane to form a dielectric resonator antenna. In one example, the dielectric resonator element is mounted on a PCB substrate in step 508. The method 500 in FIG. 5 can also be used to simultaneously make multiple dielectric resonator elements. The method 500 in FIG. 5 can also be used to make a dielectric resonator antenna array, such as the one described with respect to FIGS. 4A and 4B.

The dielectric resonator antenna and the dielectric resonator antenna array of the above embodiments can be used in communication devices, such as wireless communication devices adapted for 5G wireless operations.

The dielectric resonator antennas in the above embodiments are compact and can be used in small-sized communication devices. The dielectric resonator antennas have simple structures and have high radiation efficiency, with wide 3-dB beamwidths in both two principle planes. The dielectric resonator antennas in the above embodiments do not require complex auxiliary components (although these can be used), such as metallic walls or PIN diodes which tend to make the antennas suffer bulky size or high loss. The dielectric resonator antennas, in particular its dielectric resonator element(s) can be made easily, and simply, using additive manufacturing techniques. The dielectric resonator antennas have simple feed network and can be easily applied to the antenna array designs. The dielectric resonator antenna arrays of the above embodiments are particularly adapted for use as wide-angle beam scanning phased antenna arrays.

It will also be appreciated that where the methods and systems of the invention are either wholly implemented by computing system or partly implemented by computing systems then any appropriate computing system architecture may be utilized. This will include stand-alone computers, network computers, dedicated or non-dedicated hardware devices. Where the terms "computing system" and "computing device" are used, these terms are intended to include any appropriate arrangement of computer or information processing hardware capable of implementing the function described.

It will be appreciated by persons skilled in the art that numerous variations and/or modifications may be made to the invention as shown in the specific embodiments without departing from the scope of the invention as broadly described. Various possible options or alternatives have been non-exhaustively provided throughout the specification. The specifically described embodiments of the invention should therefore be considered in all respects as illustrative, not restrictive.

For example, the dielectric resonator element(s) can be made into different shape(s), form(s), dimension(s), etc., other than those illustrated. The dielectric resonator element(s) can be made with different materials with different dielectric constants, other than those illustrated. The dielectric resonator element(s) can be formed with two portions or more than two portions, of different shapes, sizes, forms, materials, dielectric constants, etc. The dielectric resonator element(s) need not be made with ceramic materials. The shape(s), form(s), dimension(s), etc., of the ground plane can vary. The shape(s), form(s), dimension(s), etc., of the feed network can vary. For example, the slot of the feed network can be cross-shaped, T-shaped, etc. The antenna can be a circularly polarized antenna, not necessarily a linearly polarized antenna as illustrated. The dielectric resonator element(s) can be made using any 3D printing techniques or made using conventional tooling/molding methods. The ground plane need not be provided by a PCB substrate. The feed network need not be a slot-feed network but can be a feed network for a different form. In the embodiments that the PCB substrate is used, the PCB substrate can take different forms, with one or more conductive layers (copper, etc.), and the dielectric constant $\varepsilon_{rs}$ of the substrate can be of any value. The values of the illustrated parameters can be different, dependent on applications.

The invention claimed is:

1. A dielectric resonator antenna, comprising:

a ground plane;

a dielectric resonator element operably coupled with the ground plane, the dielectric resonator element including a first portion in the form of a cylinder with a radius, and a second portion in the form of a regular truncated spheroid, the regular truncated spheroid having a major axis length and a minor axis length, the minor axis length being substantially the same as the radius, the first portion being arranged between the second portion and the ground plane; and a feed network operably coupled with the dielectric resonator element for exciting the dielectric resonator antenna;

wherein the dielectric resonator antenna, when excited, is arranged to provide wide half-power beam-widths in both E-plane and H-plane.

2. The dielectric resonator antenna of claim 1, wherein the dielectric resonator antenna, when excited, is arranged to provide:

a half-power beam-width of larger than 900 in the E-plane; and a half-power beam-width of larger than 900 in the H-plane.

3. The dielectric resonator antenna of claim 2, wherein the dielectric resonator antenna, when excited, is arranged to provide:

a half-power beam-width of larger than 1100 in the E-plane; and a half-power beam-width of larger than 1100 in the H-plane.

4. The dielectric resonator antenna of claim 3, wherein the dielectric resonator antenna, when excited, is arranged to provide:

a half-power beam-width of about 120° to about 130° in the E-plane; and a half-power beam-width of about 120° to about 130° in the H-plane.

5. The dielectric resonator antenna of claim 1, wherein the first portion has a first dielectric constant and the second portion has a second dielectric constant different from the first dielectric constant.

6. The dielectric resonator antenna of claim 1, wherein the first portion is made of a first material and the second portion is made of a second material different from the first material.

7. The dielectric resonator antenna of claim 1, wherein the first portion and the second portion are integrally formed.

8. The dielectric resonator antenna of claim 7, wherein the dielectric resonator element is additively manufactured.

9. The dielectric resonator antenna of claim 1, wherein the dielectric resonator element is rotationally symmetric.

10. The dielectric resonator antenna of claim 1, wherein the regular truncated spheroid is a hemi-spheroid.

11. The dielectric resonator antenna of claim 1, wherein the regular truncated spheroid is a hemi-spheroid and is directly connected with the cylinder to form the dielectric resonator element.

12. The dielectric resonator antenna of claim 1, wherein the dielectric resonator element is mounted on the ground plane.

13. The dielectric resonator antenna of claim 1, wherein the feed network comprises a slot in the ground plane, wherein in plan view the slot is within a footprint of the dielectric resonator element.

14. The dielectric resonator antenna of claim 13, wherein the slot has a rectangular cross section.

15. The dielectric resonator antenna of claim 13, wherein in plan view the slot is arranged centrally within the footprint of the dielectric resonator element.

16. The dielectric resonator antenna of claim 13, further comprising a PCB substrate with an outer surface with a conductive layer, and the ground plane is provided by the conductive layer.

17. The dielectric resonator antenna of claim 16, wherein the feed network further comprises a microstrip feedline arranged on an outer surface of the PCB substrate opposite the conductive layer.

18. The dielectric resonator antenna of claim 1, wherein the ground plane has a size of at least $\lambda_o \times \lambda_o$, where $\lambda_o$ is a wavelength in air at a center frequency of an operation band of the dielectric resonator antenna.

19. A communication device comprising the dielectric resonator antenna of claim 1.

20. The communication device of claim 19, wherein the communication device is a wireless communication device adapted for 5G wireless operations.

21. A dielectric resonator antenna array, comprising:

a ground plane;

a plurality of dielectric resonator elements arranged on the ground plane, each of the plurality of the dielectric resonator elements including, respectively, a first portion in the form of a cylinder with a radius, and a second portion in the form of a regular truncated spheroid, the regular truncated spheroid having a major axis length and a minor axis length, the minor axis length being substantially the same as the radius, the first portion being arranged between the second portion and the ground plane; and a feed network operably coupled with the dielectric resonator elements for exciting the dielectric resonator antenna array;

wherein the dielectric resonator antenna array, when excited, is arranged to provide angle scanning in both E-plane and H-plane.

22. The dielectric resonator antenna array of claim 21, wherein the dielectric resonator antenna array is a phased antenna array.

23. The dielectric resonator antenna array of claim 21, wherein the feed network comprises a plurality of sub-networks each associated with a respective dielectric resonator element.

24. The dielectric resonator antenna array of claim 21, wherein the first portion is made of a first material and the second portion is made of a second material different from the first material.

25. The dielectric resonator antenna array of claim 21, wherein the plurality of dielectric resonator elements are additively manufactured.

26. The dielectric resonator antenna array of claim 21, wherein for each respective one of the plurality of the dielectric resonator elements: the regular truncated spheroid is a hemi-spheroid and is directly connected with the corresponding cylinder to form the dielectric resonator element.

* * * * *